United States Patent [19]

Weiller

[11] Patent Number: 4,481,729

[45] Date of Patent: Nov. 13, 1984

[54] OVERHEAD AND FASCIA SIGN

[75] Inventor: Peter J. Weiller, Armonk, N.Y.

[73] Assignee: Thomson-Leeds Company, Inc., New York, N.Y.

[21] Appl. No.: 471,229

[22] Filed: Mar. 2, 1983

[51] Int. Cl.[3] ..... G09F 15/00

[52] U.S. Cl. ..... 40/606; 40/584; 40/601; 40/605; 40/607

[58] Field of Search ..... 40/584, 585, 601, 605, 40/606, 607; 248/298, 231.4

[56] References Cited

U.S. PATENT DOCUMENTS

| | | | |
|---|---|---|---|
| 238,483 | 3/1881 | Budd | 40/584 |
| 1,994,016 | 3/1935 | Decker | 40/607 |
| 2,772,494 | 12/1956 | Bishop | 40/605 |
| 2,785,487 | 3/1957 | Hopp | 40/607 |
| 2,960,784 | 11/1960 | Frey et al. | 40/607 |
| 3,167,874 | 2/1965 | Pogue | 40/606 |
| 3,240,455 | 3/1966 | Swezy et al. | 248/231.4 |
| 3,355,174 | 11/1967 | Hutson | 40/606 |

*Primary Examiner*—Gene Mancene
*Assistant Examiner*—Cary E. Stone
*Attorney, Agent, or Firm*—Howard C. Miskin

[57] ABSTRACT

A display panel structure includes a pair of longitudinally spaced vertically adjustable posts provided at their bottoms with mounting clamps and at their tops with transverse support rods terminating in short upright legs which engage apertures in coupling lugs projecting inwardly from rectangularly arranged corner members and tie rods extend between and separably engage diagonally spaced corner members. Fascia panels extend between each pair of corner members and have in their rear faces keyhole slots which releasably engage enlarged head coupling elements projecting outwardly from the corner members. A bracket is vertically adjustably mounted on each post and carries for transverse adjustment an arm terminating in a coupling element carrying plate and a fascia panel extends between the plates and has keyhole slots engaging the coupling elements.

11 Claims, 14 Drawing Figures

3
44
3
51
27
26
27
26
4
86
84
28
18
18
11
4

FIG. 6
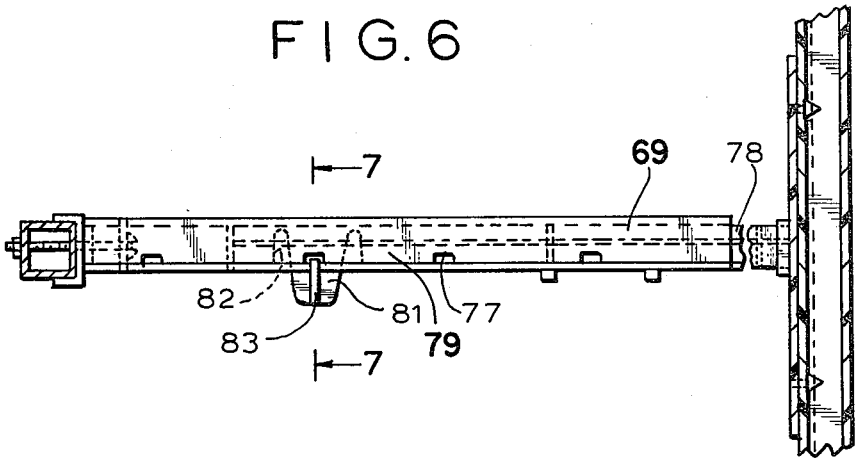
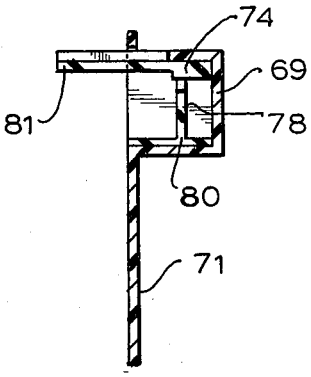
FIG. 7
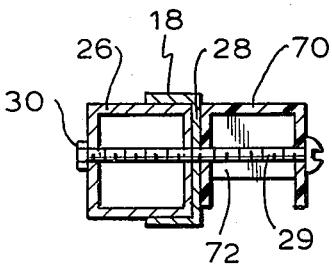
FIG. 8
FIG. 9
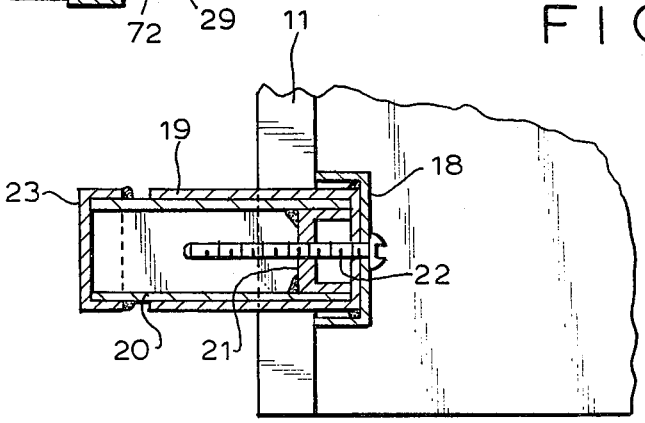

OVERHEAD AND FASCIA SIGN

BACKGROUND OF THE INVENTION

The present invention relates generally to improvements in display devices and it relates more particularly to an improved structure for supporting display panels on existing structures.

In many retail and other establishments such as supermarkets, department stores, hardware stores and the like the merchandise is stored in rack and shelf arrangements for display and dispensing purposes. However, in these arrangements the merchandise holding shelves cannot be located above a relatively low level since the merchandise would be out of the convenient reach of the customer and this leaves considerable free space between the uppermost shelf and the ceiling which in such public accomodating areas is generally higher than conventional which results in the highly inefficient employment of building space. While such wasted high level space is unsuitable for dispensing merchandise much of it is highly visually accessible.

SUMMARY OF THE INVENTION

A principal object of the present invention is to provide an improved display device.

Another object of the present invention is to provide an improved display structure which may be easily and readily assembled from prefabricated components and disassembled.

Still another object of the present invention is to provide an improved display panel supporting structure for mounting on existing merchandising racks and shelf structures in retailing establishments such as supermarkets, department stores and the like.

A further object of the present invention is to provide a display panel carrying structure of the above nature characterized by its ease of assembly and disassembly, ruggedness, convenience of application, attractive appearance, lost cost, and high versitility and adaptability.

The above and other objects of the present invention will become apparent from a reading of the following description taken in conjunction with the accompanying drawings which illustrate a preferred embodiment thereof.

A display device in accordance with the present invention includes a vertical support structure having at its upper end a pair of adjustably longitudinally spaced transversely extending parallel support members terminating at their ends in coupling elements and having at its lower end a mounting device, quadrilaterally arranged vertical corner members releasably coupled to respective support member coupling elements and having on their outer faces first separable fasteners, and fascia panels extending between pairs of the corner members and having on their rear faces second separable fasteners complementary to and releasably engaging the first separable fasteners.

As applied to the mounting of display panels above a merchandise dispensing rack the improved display device advantageously includes a pair of separate longitudinally spaced clamps for engaging the top of a rack vertical back wall each of the clamps having a vertical leg which supports a post for vertical adjustment each post having fixed to its top a transverse rod terminating in short upright coupling legs. Each corner member has a first gusset having an opening engaging a respective transverse rod coupling leg and a second gusset which has an opening engaging the upright leg of a stringer extending between each pair of diagonally spaced corner members. Located on the corner member outside faces are pins with enlarged heads which releasably engage keyhole slots formed in the rear walls of hollow fascia panels extending between pairs of corner members. Also located on each of the clamp vertical legs is a horizontal transverse leg which slidably adjustably supports an outwardly projecting arm terminating in a longitudinal plate to which are affixed coupling pins with enlarged heads and a hollow display panel having keyhole slots in its rear wall engaging respective coupling pins on the projecting arms.

The improved display structure is easily assembled and mounted and readily disassembled, is rugged and inexpensive and of attractive appearance and is of great versitility and adaptability.

BRIEF DESCRIPTION OF THE DRAWINGS

FIG. 6 is a sectional view taken along line 6—6 in FIG. 3;

FIG. 7 is a sectional view taken along line 7—7 in FIG. 6;

FIG. 8 is a sectional view taken along line 8—8 in FIG. 3;

FIG. 9 is a sectional view taken along line 9—9 in FIG. 3;

DESCRIPTION OF THE PREFERRED EMBODIMENT

Figure 1A:
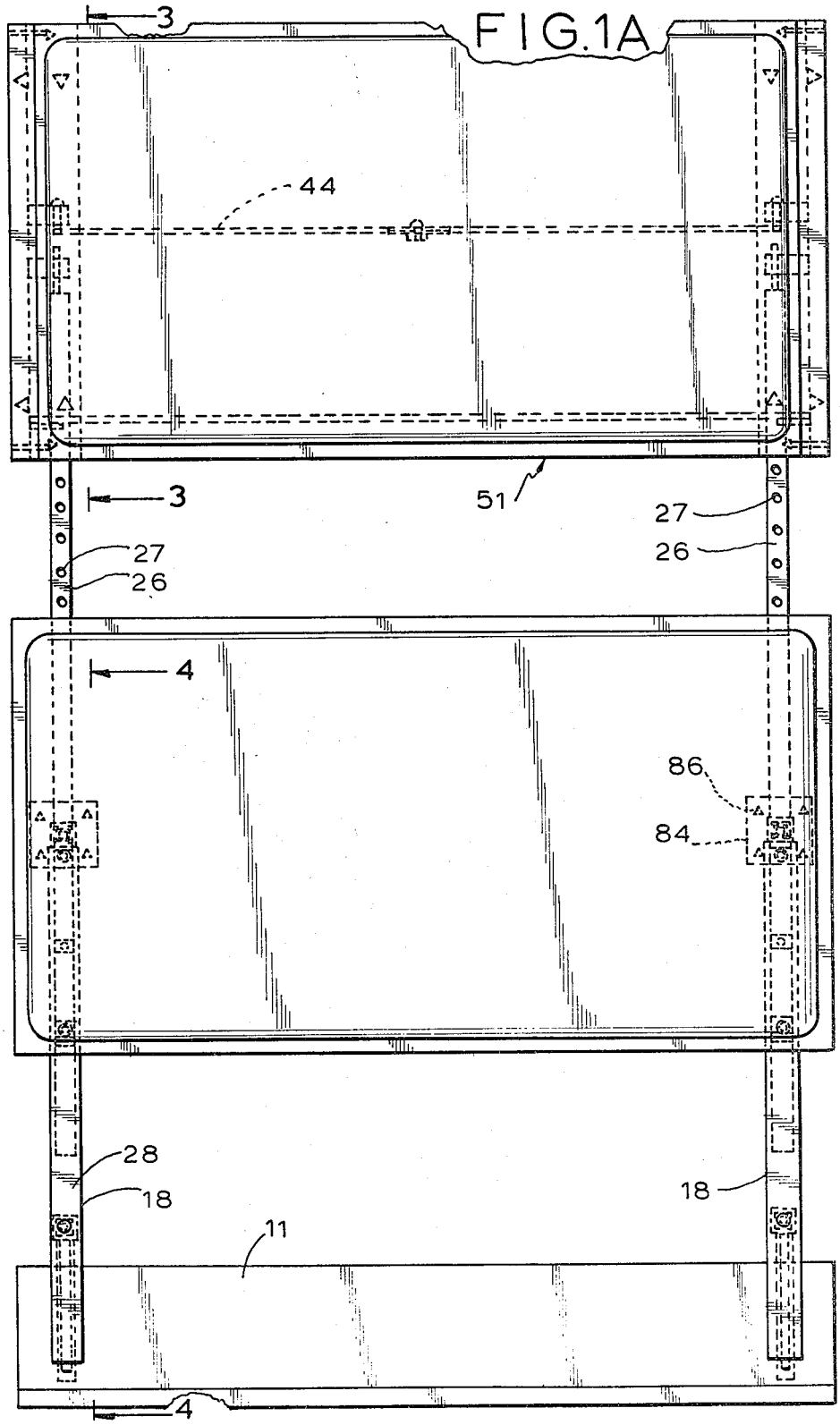
FIG. 1A is a front elevational view of a display structure according to the present invention illustrated mounted to the rear wall of a display rack or shelving.
Figure 1B:
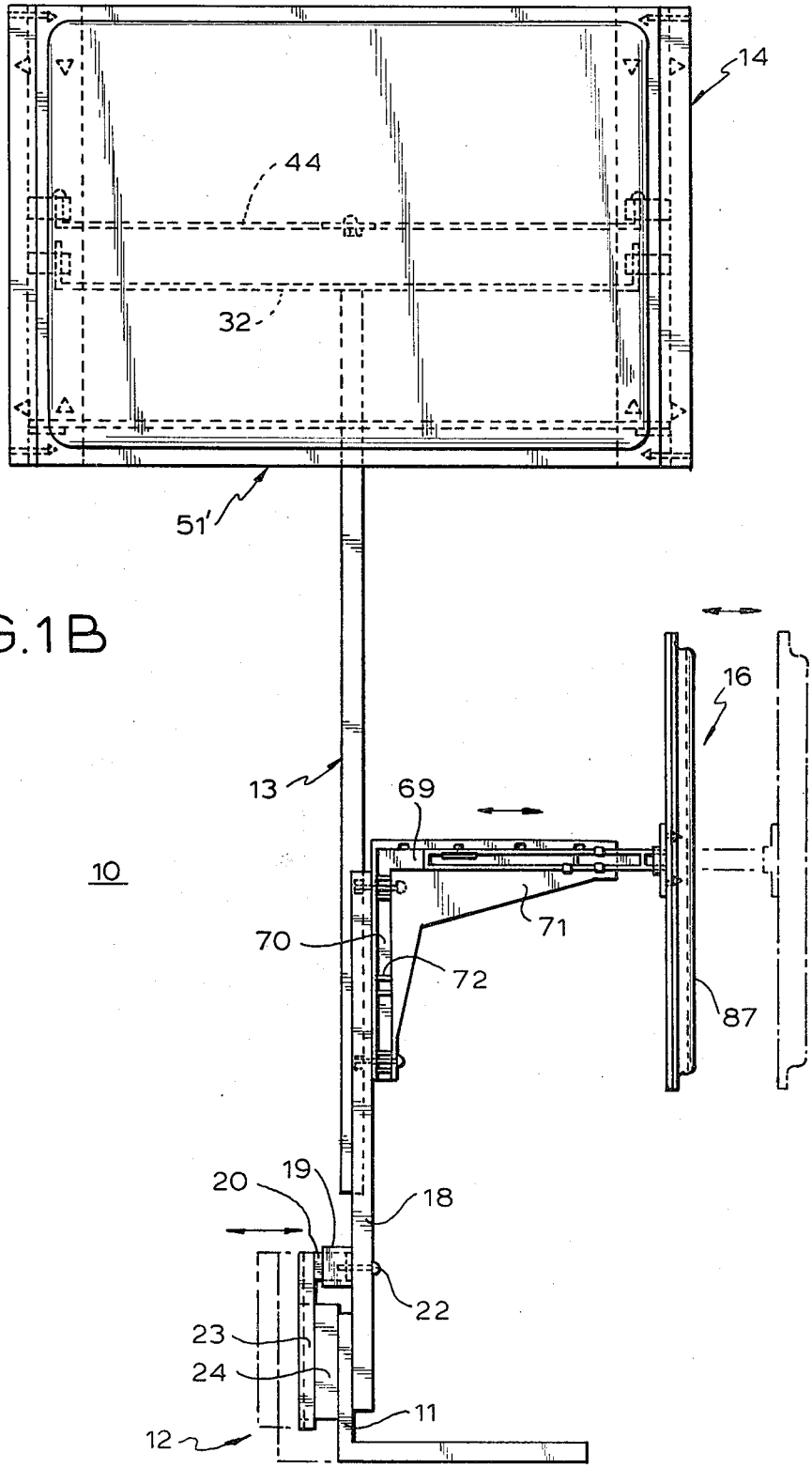
FIG. 1B is a side elevational view thereof.
Figure 2:
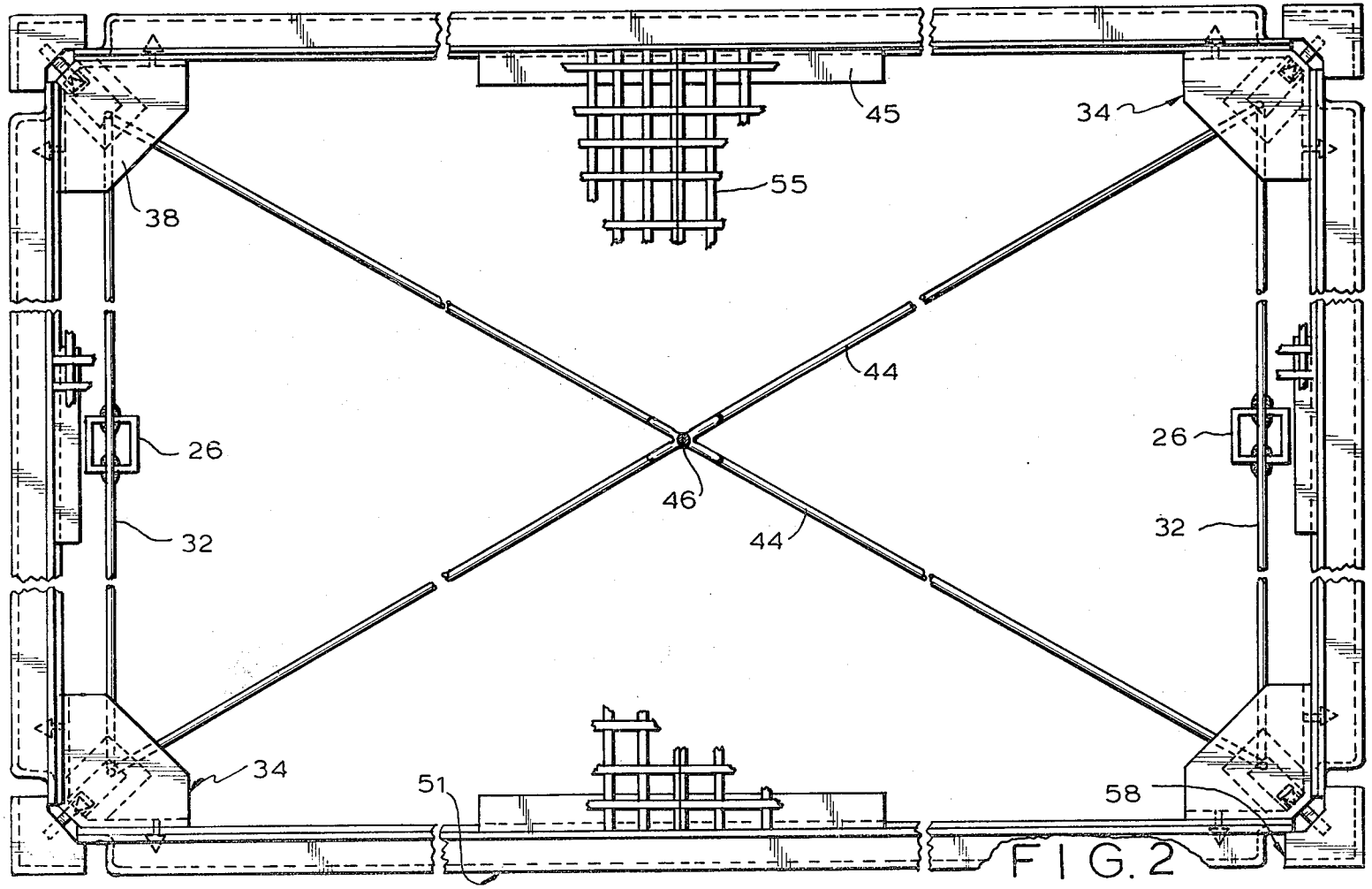
FIG. 2 is a top plan view thereof, partially fragmented.
Figure 3:
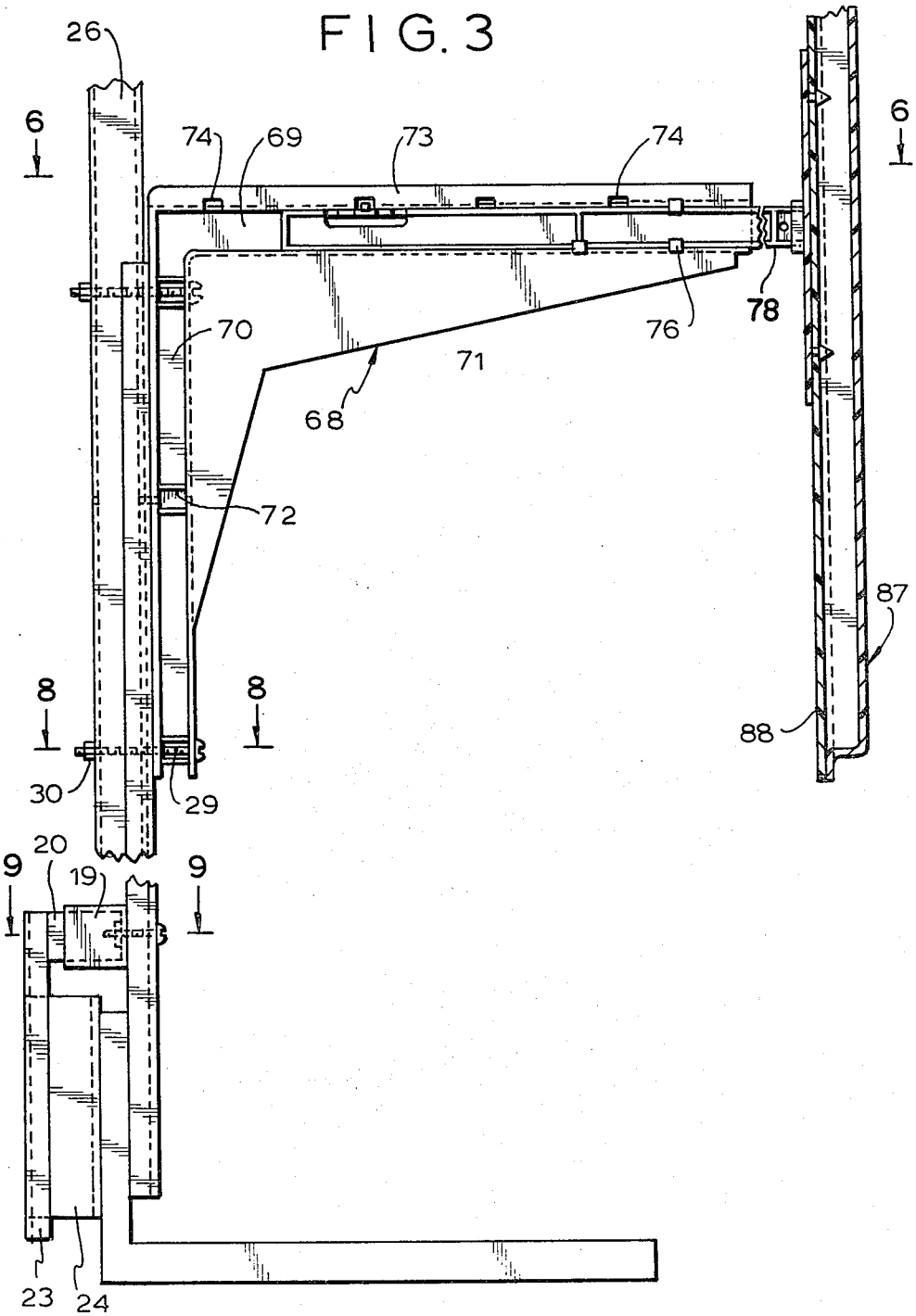
FIG. 3 is an enlarged sectional view taken along line 3—3 in FIG. 1A.
Figure 4:
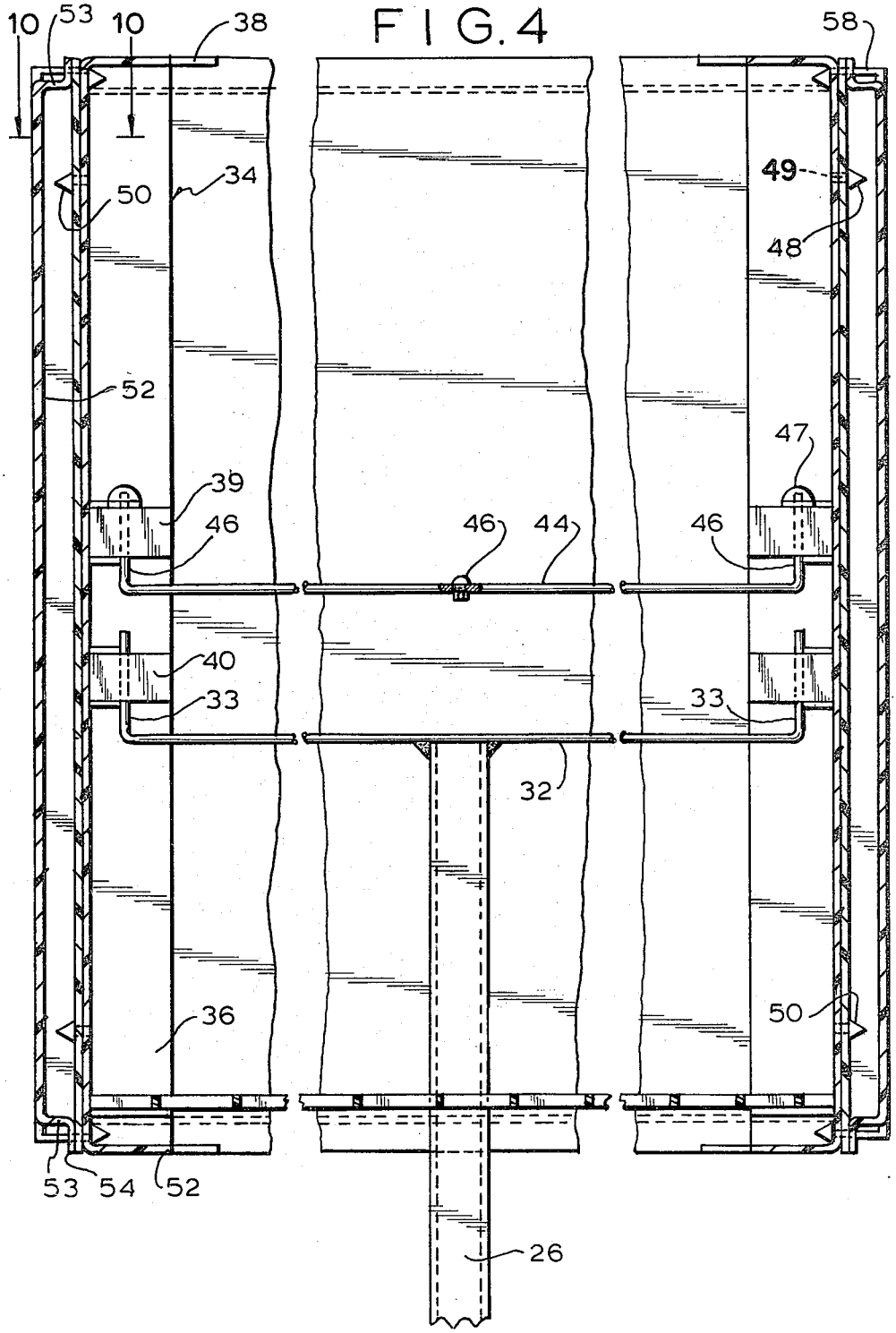
FIG. 4 is an enlarged sectional view taken along line 4—4 in FIG. 1A.
Figure 5:
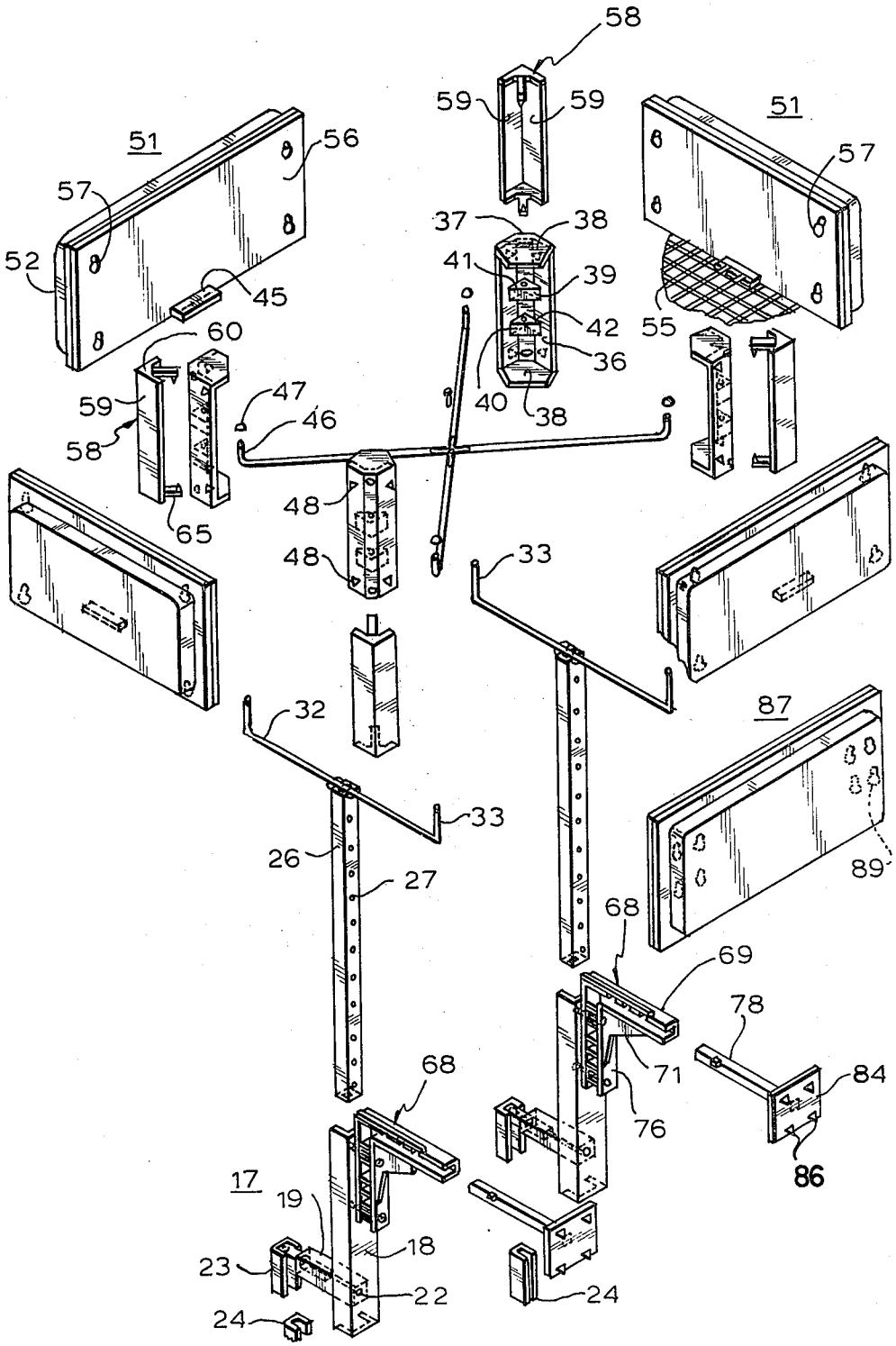
FIG. 5 is an exploded perspective view of the structure.
Figure 10:
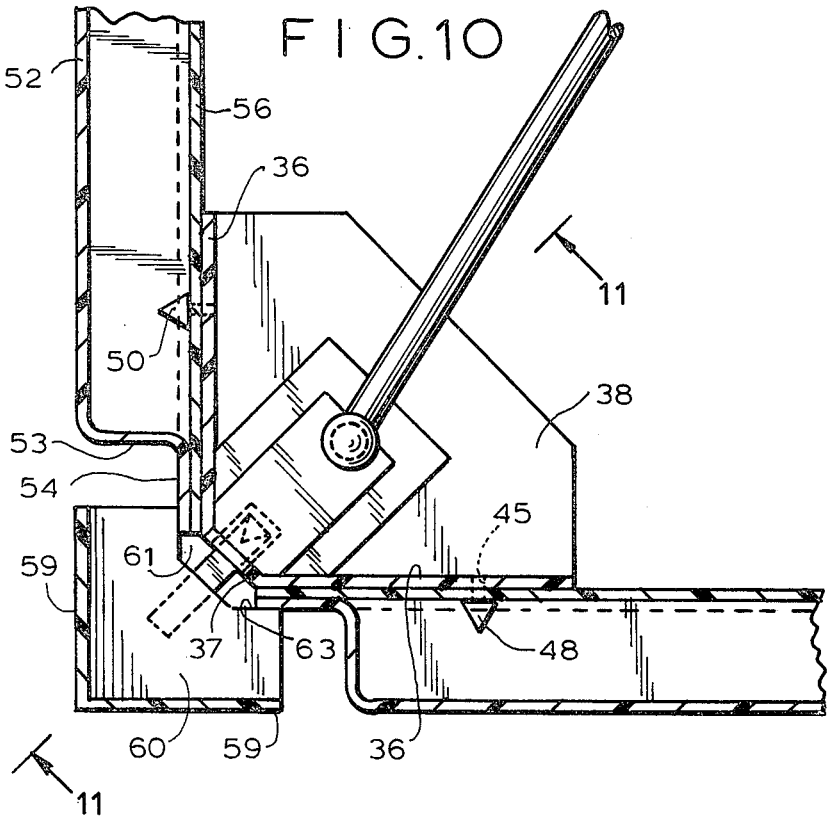
FIG. 10 is an enlarged sectional view taken along line 10—10 in FIG. 4.
Figure 11:
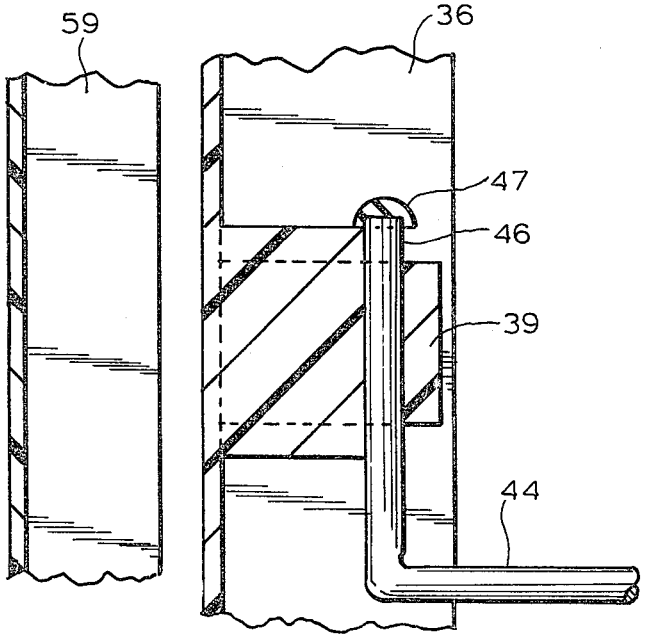
FIG. 11 is a sectional view taken along line 11 in FIG. 10.
Figure 12:
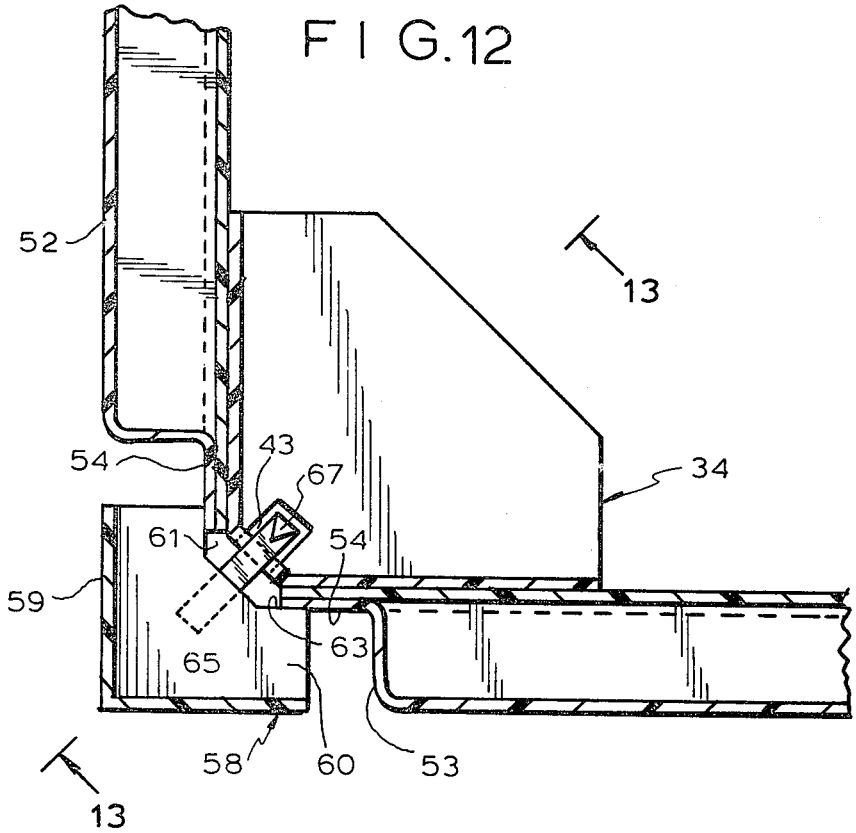
FIG. 12 is an elarged sectional view taken along line 12—12 in FIG. 4.
Figure 13:
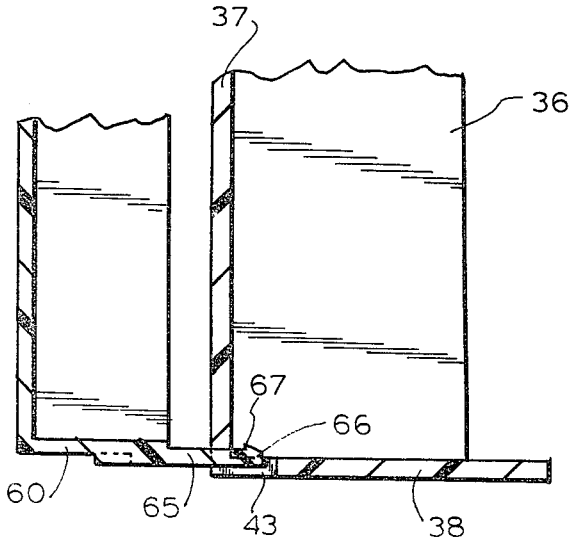
FIG. 13 is a sectional view taken along line 13—13 in FIG. 12.

Referring now to the drawings which illustrate a preferred embodiment of the present invention the reference numeral 10 generally designates the improved display device which is illustrated, by way of example, mounted to the back or vertical support wall 11 of a rack or shelf structure 12. Display device 10 includes a main support structure 13, a replaceable fascia upper panel assembly 14 and a lower replaceable panel assembly 16.

Main support structure 13 comprises a pair of longitudinally spaced similar bottom mounting clamp sections 17 each including a vertical channel member 18 having welded to its inside face above the bottom thereof a rearwardly projecting rectangular guide sleeve 19 which is longitudinally slidably telescoped by a similarly shaped slide member 20 having affixed to its rear interior portion an inner end wall 21 having a central tapped bore. An adjusting screw 22 engages the tapped bore in end wall 21 and an axially aligned bore in channel member 18, the head of screw 22 bearing on the outside face of channel member 18. Secured to the free end of slide member 20 is a depending channel shaped arm 23 which with the lower portion of channel member 18 defines a pair of clamp arms which are tightened and loosened by turning screw 22. A channel shaped spacing block 24 partially nests on clamp arm 23 and projects toward channel member 18 to facilitate mounting to a relatively thin wall 11.

Vertically slidably engaging the channel in each member 18 is a vertical tubular post 26 of square transverse cross section having formed on its front and rear walls a plurality of vertically spaced pairs of transversely coaxially aligned apertures 27. A pair of apertures are formed in the cross web 28 of channel member 18 and are vertically spaced a distance equal to an integral multiple of the spacing between successive pairs of apertures 27. As will be hereinafter described, the posts 26 are vertically adjustable on channel members 18 to the desired height and releasably fixed in the preadjusted position by a pair of screws 29 engaging corresponding sets of aligned apertures in web 28 and apertures 27 and in turn being engaged by nuts 30. Affixed to the tops of posts 26 is a pair of horizontal parallel transverse similar support rods 32 terminating at their ends in upwardly projecting vertical short coupling legs 33 which are quadrilaterally positioned at a common level.

Releasably engaged by each of the coupling legs 33 is an upright corner member 34 which includes mutually perpendicular vertical rectangular side walls 36 joined by a diagonal vertical corner wall 37, top and bottom edges of walls 36 and 37 being joined by inwardly projecting hexagonal horizontal end walls 38. A pair of vertically spaced upper and lower heavy plate gussets or blocks 39 and 40 extend between and are affixed to side walls 36 and have vertically axially aligned coupling bores 41 and 42 formed respectively in gussets 39 and 40. Formed in the outer edge of each end wall 38 along a contiguous edge of corner wall 37 is a coupling slot 43.

A corner member 34 is located at each end of each support rod 34 with the lower gusset coupling bore 42 being slidably engaged by a respective coupling leg 33. A pair of stringers 44 formed of rod are flatted intermediate their ends and are horizontally swingably joined by a pivot pin 46 engaging openings in the stringer flatted portions. Each stringer 44 extends between and joins diagonally spaced corner member 34 and terminates in upwardly directed coupling legs 46 engaging respective upper gusset coupling bores 41. The free end of each coupling leg 46 is engaged by a selectively releasable hemispherical cap 47. A pair of vertically spaced keyhole engagable male coupling elements 48 is affixed to and projects outwardly from the outside face of each corner member side wall 36, each coupling element 48 including a shank 49 terminating at its outer end in an enlarged conical head 50.

A fascia panel 51 carrying on its outer face, in any suitable manner, any desired informational or advertising material extends between and is releasably supported by each pair of longitudinally or transversely spaced coplanar corner member side walls 36. Each fascia panel 51 includes a rectangular front wall 52 having a rearwardly projecting peripheral skirt wall 53 terminating in a planar peripheral flange 54. A rectangular rear panel 56 having the same periphery as flange 54 has a peripheral border superimposed on and coinciding with flange 54 and suitably affixed thereto such as by cement or heat fusion. Formed in rear panel 56 proximate each of its side borders is a pair of vertically spaced keyhole coupling slots 57 having enlarged bottom openings the vertical and horizontal spacing between keyhole slots 57 corresponding to that between corresponding coupling elements 48. Each panel 51 is connected between and to a pair of coplanar spaced corner walls by passing the enlarge openings of the keyhole slots 56 over coupling element enlarged heads 50 and then lowering the panel so that the upper parts of the keyhole slots engage shanks 49.

A corner fascia or cover member 58 is connected to each corner member 34 and includes a pair of mutually perpendicular vertical walls 59 coplanar with and spaced from respective front panels 52 and horizontal end walls 60 each of which has medially formed at its inner end a recess 61 with side edges 63 bearing on panel flanges 54. A coupling tongue 65 projects diagonally inwardly from the outside face of each end wall 60 and engages a respective corner member slot 43. Tongue 65 is resilient and terminates at its inner end in an enlarged head 66 having an inner forwardly inwardly inclined face 67 and a vertical rear shoulder confronting a respective corner wall 37. A rectangular grill 55 rests on medial flanges 45 projecting inwardly from the bottom edges of fascia rear panels 56.

The lower panel assembly 16 comprises a bracket 68 including an upper forwardly projecting horizontal channel arm 69 joined at its rear in a depending rear vertical channel arm 70, the outer border of the inner legs of bracket channel arms 69 and 70 being joined by reinforcing gusset plate 71. The outer rear leg of bracket arm 70 abuts the front face of vertical channel member 18 and vertically spaced walls defining transverse sleeves or passageways 72 extend between the side legs of channel arm 70 and are aligned with respective openings in these side legs, the passageways and opening being engaged by screws 29 permitting the releasable independent vertical adjustment of posts 26 and brackets 68 along channel member 18.

Projecting upwardly from the outer edge of the top leg of channel arm 69 is a flange 73 having formed along its juncture with the channel arm top leg a plurality of spaced indexing slots 74. Retainer guide members 76 are located along the edges of the upper and lower legs of channel arm 69. Formed in the top leg 78 of channel arm 69 and extending from each indexing slot 74 is a corresponding respective recess 77.

Slidably telescopingly engaging the channel in each bracket arm 69 and retained therein by guide members 76 is a slide member 78 having transverse reinforcing walls, and top and bottom walls 79 and 80 engaging the top and bottom inside faces of channel arm 69. Integrally formed with slide member top wall 79 is a transversely projecting resilient tongue 81 extending beyond the edge of the top wall of channel member 69 and delineated along its length from slide top wall 79 by transverse side recesses 82 formed in top wall 79. A longitudinal medial ridge 83 is formed in the top face of tongue 81 and when registering with a selected slot 77 resiliently engages the slot to releasably lock slide member 78 in a preselected position.

A vertical rectangular plate 84 lying in a longitudinal plane is affixed to the outer end of each slide member 78 and coupling elements 86 similar to coupling elements 48 project forwardly from each corner of plate 84. A fascia panel 87 similar in construction to fascia panels 51 includes a rear panel 88 having longitudinally spaced sets of four keyhole slots complementary and releasably engaging respective sets of coupling elements 84 to separably support the fascia panel 87 which is transversely and vertically adjustable on the support structure which in turn is adjustable along the length of rack wall 11.

The assembly and mounting, the disassembly and the adjustment of the display device 10 are clear from the above description. The length of the transverse fascia panels 51 are determined by the lengths of transverse support rod 32 whereas the lengths of longitudinal fascia panels 51 and 87 may be varied and the spacing between the rack wall engaging mounting clamps accordingly adjusted. The fascia panels may be formed of any desirable plastic as may many of the other components of the display device 10 thereby contributing to its low cost and light weight without adversely effecting its ruggedness, reliability and usefulness and the outer faces of the fascia panels may carry any desirable information or advertising which may be directly applied thereto or may be a separate poster suitably secured to the panel.

While there has been described and illustrated a preferred embodiment of the present invention it is apparent that numerous alterations, omissions and additions may be made without departing from the spirit thereof.

I claim:

1. A display device comprising a vertical support structure including at its upper end a pair of longitudinally spaced transversely extending parallel support members terminating at their outer ends in separable coupling sections and at its lower end means for mounting said support structure, said support structure including a pair of longitudinally spaced brackets between the top and bottom thereof having forwardly projecting parallel guide legs, quadrilaterally arranged vertical corner member releasably coupled to respective support members coupling sections and having on their outer faces first separable fastening means, fascia panels extending between pairs of said corner members and having on their rear faces second separable fastening means releasably engaging said first fastening means, an arm supported by and adjustable along each of said guide legs and terminating at its free end in a first coupling members and a fascia panel extending between said first coupling members and having second coupling members releasably engaging said first coupling member.

2. The display device of claim 1 including a tie rod extending between and separably connected to each pair of diagonally spaced corner members.

3. The display device of claim 2 wherein each corner member includes a pair of relatively perpendicular vertical plates joined by vertically spaced horizontal first and second gussets with coupling openings, said support member coupling sections comprising upright vertical legs engaging said first gusset openings and said tie rods terminating in vertical coupling legs engaging said second gusset openings.

4. The display device of claim 1 wherein said vertical support structure comprises a pair of longitudinally spaced separate clamp members and a post vertically adjustably secured to each of said clamp members and having affixed to their upper ends said support members.

5. The display device of claim 1 wherein said first separable fastening means comprise shank elements terminating in enlarged heads projecting outwardly from said corner member and said second separable fastening means are defined by keyhole slots in said fascia panel rear faces.

6. The display device of claim 1 wherein said support structure comprises a pair of longitudinally spaced clamp members defining said mounting means and including a pair of vertical channel members, a vertical post vertically slidably engaging each of said channel members and means for releasably locking said posts to said channel member in preselected positions.

7. The display device of claim 6 wherein each of said support members comprises a rod terminating in upwardly projecting coupling legs defining said separable coupling sections and each of said vertical corner members includes a horizontal first gusset having an opening engaging a respective coupling leg.

8. The display device of claim 7 wherein each of said corner members includes a horizontal second gusset vertically spaced from said first gusset and having a second coupling opening therein a tie rod extending between diagonally opposit corner member and terminating at their opposite ends in vertical legs engaging respective second coupling openings.

9. The display device of claim 1 wherein each of said fascia panels comprises a front panel having a rearwardly directed perpheral skirt wall terminating in a planar peripheral flange and a rear panel having a peripheral border overlying, coinciding with and secured to said peripheral flange, said rear panel having formed therein inwardly of said peripheral border keyhole slots defining said second separable fastening means.

10. A display device comprising a support structure including a pair of longitudinally spaced mounting means defining clamp members including a pair of longitudinally spaced vertical channel member and a vertical post vertically slidably engaging back of said channel members and means for releasably locking said posts to said channel members in preselected positions, said support structure including at its upper end a pair of adjustably longitudinally spaced transversely extending parallel support members terminating at their outer ends in separable coupling sections, quadrilaterally arranged vertical corner members releasably coupled to respective support member coupling sections and having on their outer faces first separable fastening means, fascia panels extending between pairs of said corner members and having on their rear faces second separable fastening means releasably engaging said first fastening means, a bracket member connected to each of said channel members and including a transversely projecting guide leg, a support arm slidably adjustably engaging each of said guide legs and terminating in a longitudinally extending vertical plate having transversely outwardly projecting shanks with enlarged heads and a fascia panel having keyhole slots in its rear face engaging said shanks.

11. A display device comprising a vertical support structure including at its upper end a pair of longitudinally spaced transversely extending parallel support members terminating at their outer ends in separable coupling sections and at its lower end means for mounting said support structure, quadrilaterally arranged vertical corner members releasably coupled to respective support member coupling sections and having on their outer faces first separable fastening means, fascia panels extending between pairs of said corner member and having on their rear faces second separable fastening means and releasably engaging said first fastening means, each of said fascia panels comprising a front panel having a rearwardly directed peripheral skirt wall terminating in a planar peripheral flange and a rear panel having a peripheral border overlying, coinciding with and secured to said peripheral flange, said rear panel having formed therein inwardly of said peripheral border keyhole slots defining said second separable fastening means and an angular face member coupled to each of said corner members and including a pair of relatively perpendicular vertical plates parallel to and spaced outwardly from corresponding faces of a respective corner member and coplanar with the front panels of the fascia panels coupled to said corner members.

* * * * *